US005679108A

United States Patent [19]

Eronen

[11] Patent Number: 5,679,108

[45] Date of Patent: Oct. 21, 1997

[54] FIXING END FOR CORES USED IN REELING

[75] Inventor: Pekka Eronen, Järvenpää , Finland

[73] Assignee: Valmet Corporation, Helsinki, Finland

[21] Appl. No.: 477,425

[22] Filed: Jun. 7, 1995

[30] Foreign Application Priority Data

Jun. 23, 1994 [FI] Finland ..... 943039

[51] Int. Cl.[6] ..... B65H 17/02

[52] U.S. Cl. ..... 492/47; 492/45; 242/573.1

[58] Field of Search ..... 492/47, 45, 1; 242/576, 573.1

[56] References Cited

U.S. PATENT DOCUMENTS

| | | | |
|---|---|---|---|
| 1,172,907 | 2/1916 | Rust | 492/45 |
| 4,148,444 | 4/1979 | Hehner | 242/68.2 |
| 4,730,779 | 3/1988 | Thievessen | 242/72 |
| 4,751,776 | 6/1988 | Reunamäki | 492/45 |
| 4,795,106 | 1/1989 | Weiss et al. | 242/72 |
| 4,800,644 | 1/1989 | Muellenberg | 492/45 |
| 5,011,094 | 4/1991 | Azuma | 242/72.1 |

FOREIGN PATENT DOCUMENTS

| | | |
|---|---|---|
| 470559 | 1/1975 | Australia . |
| 0531285 | 12/1991 | European Pat. Off. . |
| 62510 | 10/1979 | Finland . |
| 861528 | 12/1986 | Finland . |
| 2344706 | 3/1975 | Germany . |
| 3601912 | 3/1987 | Germany . |
| 3533735 | 4/1987 | Germany . |
| 3641255 | 4/1988 | Germany . |
| 669582 | 3/1989 | Switzerland . |
| 2187818 | 9/1987 | United Kingdom . |

*Primary Examiner*—Irene Cuda

*Attorney, Agent, or Firm*—Steinberg, Raskin & Davidson, P.C.

[57] ABSTRACT

A fixing end for cores used for reeling including wedge pieces movable in an axial direction and bevelled holes bored on the outer circumference of the fixing end and out of which a holding surface of the wedge pieces ascends for locking the fixing end securely to an inner surface of the core. The radial motion of the holding surface of the wedge piece into and out of the hole, i.e. relative to the outer surface of the fixing end, is forced-controlled and the forced-control is provided by means of the axial motion of the wedge piece.

12 Claims, 2 Drawing Sheets

FIXING END FOR CORES USED IN REELING

BACKGROUND OF THE INVENTION

The present invention relates to a fixing end for roll cores used in reeling. The fixing end comprises wedge pieces moving in a substantially axial direction of the fixing end and core and situated in bevelled holes bored on the outer circumference of the fixing end. The wedge pieces move out of the bevelled holes in the axial direction such that the holding surface of the wedge pieces ascend and lock the wedge piece securely against the inner surface of the core.

As well known in the art, in rolling paper web and other web-like materials, cores are used which are attached to the rolling means by fixing ends. Owing to highly increased reeling speeds, the fixing means of cores or equivalent are required to meet higher and higher operation requirements. The penetration of fiber dust between the parts of the fixing end has been particularly a problem, as the fixing end becomes locked so that releasing it is difficult and takes a great deal of time.

With regard to the state of art, reference is made to Finnish patent specification No. 62 510, in which a fixing end is disclosed for cores to be used in reeling. In this design, inner and outer wedge pieces are employed which can be moved together axially so that the core can be positioned in place and in which the axial movability of the inner wedge pieces in the direction of the power effect of the compression element is limited by an adjustment member.

With further regard to the prior art, reference is made to Finnish Patent Application No. 861528 which describes means for fastening tubular reeling cores, particularly reeling cores supporting paper webs or equivalent material webs, in which expansion created by torque is used for the fixing operation. The return operation is spring-acting when initiated. One problem with this arrangement is that the means remain stuck in the fixing position.

Reference is also made to European Patent Publication No. 0 531 285 which describes a fixing end for reeling cores in which by means of bevelled surfaces of the fixing piece, a fixing piece is fastened using expansion of the bevelled surfaces of the fixing end provided by torque as the fixing end hits a stopper. As the return member of the fixing end the spring return is used.

Further, reference is made to German Patent Publication Nos. DE 3 641 255 and 3 601 912 which describe fixing arrangements wherein the return of the fixing end into release position may be problematic.

Reference is also made to German Patent Publication No. DE 3 533 735 which describes a construction in which the spaces of different intermediate pieces and others may be problematic, and which in other aspects may cause problems in providing secure fixing/releasing.

As becomes obvious from what is described in the foregoing, a specific problem in the constructions known in the art is how to return the fixing end back to the release position which is particularly due to the fact that the dust from fibers becomes wedged between the fixing end parts, whereby the fixing members do not move back to their initial position from the expansion position.

Problems are moreover caused in prior art constructions by means of the torque and potential clearances of pieces between different parts of the complicated constructions, which may even lead to rocking of the core in the course of reeling.

OBJECTS AND SUMMARY OF THE INVENTION

An object of the present invention is, therefore, to provide a design for eliminating the problems of the fixing ends for cores mentioned above.

A more specific object of the present invention is to create a design in which fiber dust does not lead to locking of the fixing end in the fixing position.

A further object of the present invention is to create a design in which the load forces can be directed at a desired point in the basic construction, whereby the fixing end will not be damaged by the load forces.

One more important object of the present invention is to provide a fixing end which is reliably insertable in and out of place.

Yet another object of the present invention is to produce a manufacturing technically preferred fixing end.

For achieving the above objects, and others, in the fixing end according to the invention, radial motion of the holding surface of the wedge piece relative to the outer surface of the fixing end is forced-controlled, i.e., controlled by a force, and the forced-control is provided by means of the axial motion of a wedge piece.

The fixing end of the invention is forced-controlled and the forced-control is based on the axial motion of the wedge piece. In the arrangement of the invention, bevelled holes are arranged, preferably bored, in an outer circumference of the fixing end, bevelled so that the principal direction of the hole is not perpendicular to the radial direction of the roll or to the axial direction of the roll. A substantially round wedge piece is arranged in each bevelled hole and one end of the wedge piece which is arranged to emerge from the hole constitutes a holding surface. The wedge piece and thus the holding surface thereof is forced out of the hole as a result of axial movement of the wedge pieces and the holding surface thus locks the fixing end firmly to the inner surface of the reeling core. In addition, the "expanding" parts of the fixing end are fixed on the actuation means so that when the actuation means moves, all moving parts of the fixing end are moving. In this manner, sticking of the seat in the holding position is substantially prevented.

Thus, in accordance with the invention, a fixing end for cores used in reeling comprises bevelled holes bored on the outer circumference of the fixing end through which a bevelled holding surface of the wedge pieces moving in axial direction ascends, locking the fixing end firmly to the inner surface of the core. The radial motion of the holding surface of the wedge piece in and out, relative to the outer surface of the fixing end, is forced-controlled, and the forced-control operation is based on the axial motion of the wedge piece which translates via the bevelled holes into radial motion of the wedge pieces.

The part of the wedge piece within the fixing end is preferably round in cross-section. In geometrical shape, the holding surface of the wedge piece is planar or rounded to be of the size of the radius of the fixing end, i.e., to conform to the inner surface of the core, or rounded somewhere therebetween. The holding surface of the wedge piece may have been roughened or grooved in axial direction for intensifying the grip.

The fixing end of the invention is highly reliable in operation because the axial motion of the wedge pieces therein is relatively large compared with the radial motion, whereby any possible fiber dust is discharged from between the wedge pieces while they are moving.

The design of the invention is simple also in design, whereby it is non-costly in manufacturing technique and in addition, reliable in operation.

Moreover, with the fixing end of the invention, the bearing of the seat can be brought inside the fixing end to be at the load forces and to transmit the force directly to the basic construction when the wedge is supported to the frame, whereby the radial forces are directly mediated to the frame of the fixing end.

In a basic embodiment, the fixing end for cores used in reeling comprises a substantially cylindrical frame having an outer surface and which is insertable into an open end of the core, bevelled holes formed in the frame and opening onto the outer surface thereof and a movable, elongate wedge piece situated in each of the holes. Each of the wedge pieces has a holding surface at one end thereof proximate to the outer surface and engagable with an inner surface of the core. Moving means are provided to move each of the wedge pieces in a direction of its longitudinal axis in the holes such that the holding surfaces of the wedge pieces move radially outward motion relative to the outer surface of the frame and engage and lock the fixing end to the inner surface of the core.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
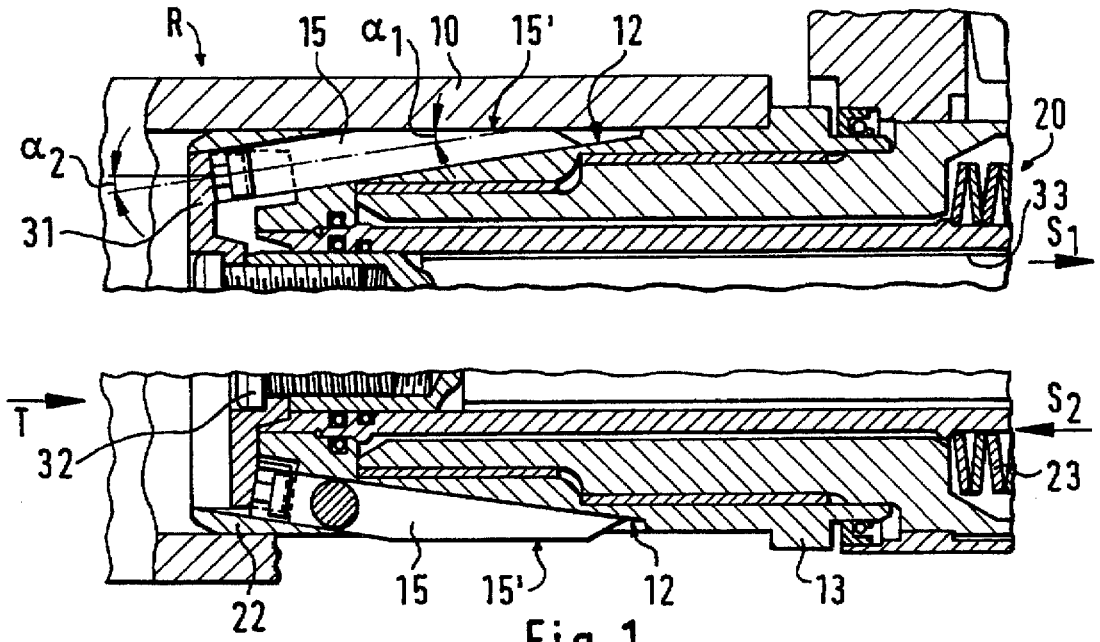
FIG. 1 is a cross-sectional view of the fixing end according to the invention.

Referring to a first embodiment of the invention shown in FIGS. 1–4, fixing means or the fixing end for fixing a core 10 to a frame are denoted generally by 20 and is substantially cylindrical and comprises wedge pieces 15 positioned on bevelled surfaces 12. A stopper piece 13 defines the maximum axial location for core 10 in the axial direction. The stopper piece 13 is formed in conjunction with the fixing means 20 which is arranged over a stationary member 14. The member 14 has an axial through hole in which a frame part 33 is positioned. The wedge piece 15 moves radially, as well as in a direction of its axis, along the bevelled surfaces 12 thus projecting beyond the outer surface of the fixing end 20 to fix the core 10 in place by means of holding surfaces 15' of the wedge pieces. The radial motion is produced forced-controlledly by means of the axial motion of the wedge piece 15, i.e., by means of the force produced by the axially moving wedge pieces, the radial motion of the wedge pieces is controlled. The axial motion of the wedge pieces 15 is relatively large, about 5 mm to about 15 mm. In this manner, radial motion of from about 0.5 mm to about 2.0 mm is produced. A T-groove fixing 19, seen most clearly in FIG. 2, functions to connect the end of the wedge piece 15 which does not project to a frame part 31, to provide a fixed connection therebetween and bind the wedge pieces 15 axially in place. According to the invention, the torque is mediated directly to the basic structure, because the wedge pieces are supported to the frame of the fixing end 20, whereby the radial forces are conducted straight to the frame. The wedge pieces 15 have thus been fastened to actuating means 23, e.g., to a plate spring, so that when the actuation means 23 provides a motion, all of the mobile parts of the fixing end are moving. In this manner, sticking of the fixing end in the holding position is prevented.

Figure 3:
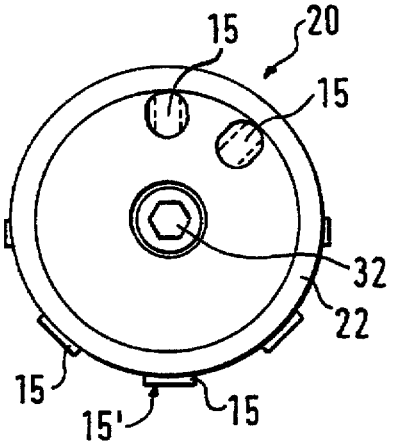
FIG. 3 is a view of FIG. 1 in the direction T.

From the bevelled holes 24 bored on the outer circumference 22 of the fixing end 20, the holding surface 15' of the wedge pieces 15 moving in axial direction arise, thus locking the fixing end firmly to the core 10 (as shown in FIG. 3). The radial motion of the holding surface 15' of the wedge piece 15 out and in, relative to the outer surface of the fixing end 20, is forced-controlled as explained above, and the forced-control is based on the axial motion of the wedge piece 15. The part within the fixing end 20 of the wedge piece 15 has a round cross-sectional shape. The holding surface 15' of the wedge piece 15 is in geometrical shape planar or rounded, preferably to be of the same size as the radius of the fixing end, or a rounding radius therebetween. The holding surface 15' of the wedge piece 15 is bevelled relative to the axial line of the wedge piece. The bevel angle $\alpha_1$ is essentially the same as the bore angle $\alpha_2$ in the holes bored in the fixing end, i.e., the angle between the longitudinal axis of each of the wedge pieces and the holding surface thereof is substantially the same as an angle between a longitudinal axis of the fixing end and an axis of the holes formed in the outer surface of the frame.

As shown in FIG. 1, the actuation means 23 of the fixing end 20, such as disc spring, while moving in direction $S_1$, pull the wedge piece 15 attached to the frame parts 31,32,33 of the fixing end in axial direction, whereby the wedge round in cross-section, moves along the bevelled surface 12 in the axial direction and at the same time, in the radial direction so that the holding surface 15' of the wedge piece 15 ascends in the radial direction out of the borings 24 made on the outer surface of the fixing end 20. For releasing the core 20, the frame parts 31,32, 33 of the fixing end are moved in the opposite direction $S_2$ to the direction of action $S_1$ of the actuation means, whereby the wedge pieces move axially in direction $S_2$ and so, the holding surfaces 15' move inward so that the core 10 can be released from its location.

Figure 2:
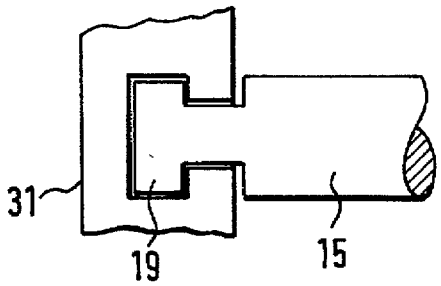
FIG. 2 is a view of FIG. 1 in the direction R.

As shown in FIG. 2, the wedge piece 15 has been attached e.g. with T-groove fixing 19 to the frame piece 31. Also other fixing systems known as such to a person skilled in the art, such as dovetail joint, serve the purpose and may be used as fastening means. The fixing arrangement 19 serves to effect axial motion of the wedge piece 15 upon axial motion of the frame part 31 to which the wedge piece 15 is fixed and at the same time, to enable radial motion of the wedge piece 15.

Figure 4:
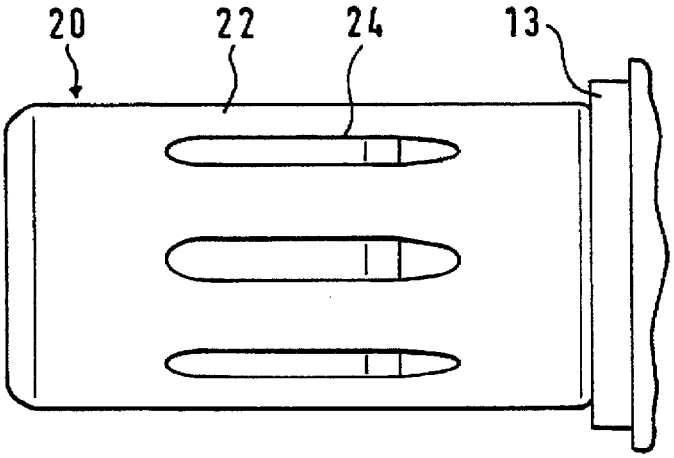
FIG. 4 is a view of the fixing end of the invention when viewed from outside.

FIG. 3 shows the fixing end 20 viewed from the middle of the core 10 and shows the radially outward moved wedge pieces 15 with the holding surfaces 15'. FIG. 4 shows the outer surface of the fixing end 20, in which the bevelled borings or holes 24 are visible, one of the wedge pieces 15 being insertable into each hole 24, and from which holes 24, the holding surfaces 15' of the wedge pieces 15 move radially outward.

Figure 5:
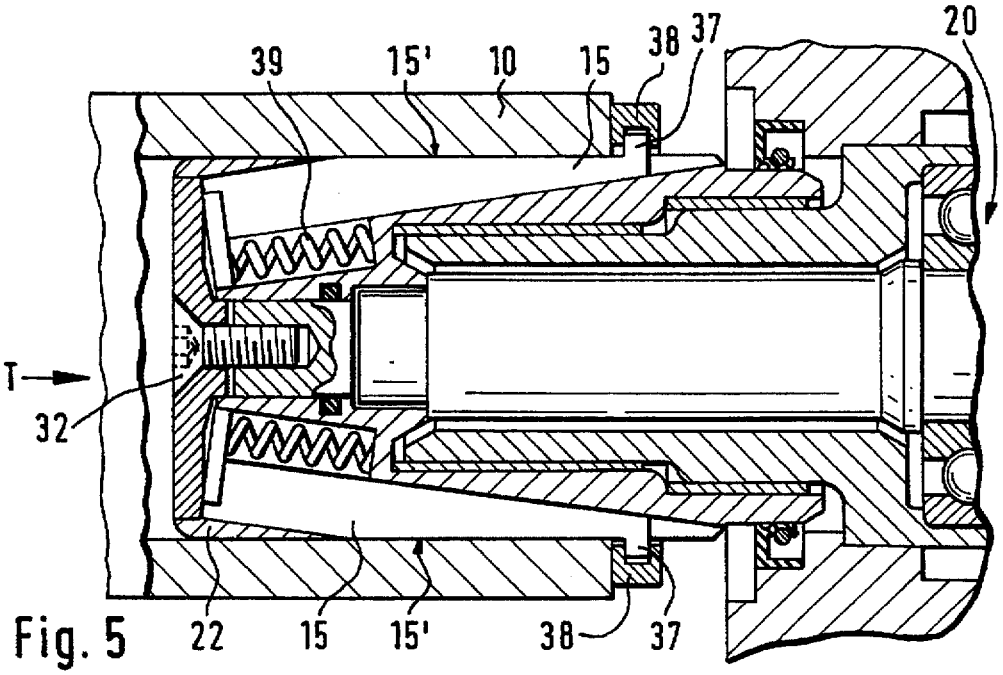
FIG. 5 is a view of a second embodiment of the fixing end of the invention.
Figure 6:
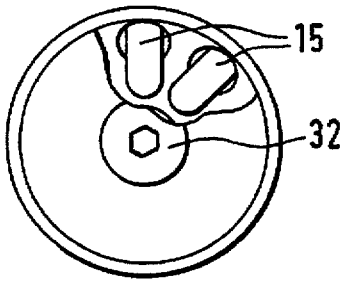
FIG. 6 is a view of the fixing end according to FIG. 5 in the direction T.
Figure 7:
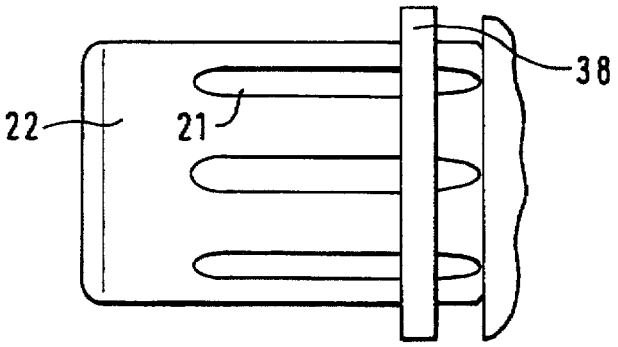
FIG. 7 is a view of the fixing end of FIG. 5 when viewed from outside.

In another embodiment of the invention shown in FIGS. 5–7, the wedge pieces 15 are not moved with a separate actuation means as in the embodiment shown in FIGS. 1–4. Instead, the expansion of the wedge pieces 15, that is, the radial motion, is provided with axial transfer of the core 10 relative to the fixing end 20. This exemplifying embodiment is not appropriate for cases in which the end face of the core 10 must be at the same point relative to the fixing end 20 in the course of the entire reeling.

As shown in FIG. 5, the wedge pieces 15 of the fixing end 20 move in an axial direction and at the same time, generate the radial motion of the holding surfaces 15'. The wedge pieces 15 comprise an end part 37 which is fixed to an annular member 38, this being supported against the end face of the core 10, whereby when the core 10 is moved in axial direction, the wedge piece 15 moves equally in axial direction, thus moving the holding surfaces 15' in radial direction. With the aid of spring members 39, the wedge pieces 15 are returned to their initial position upon movement of the core relative to the fixing end in an opposite direction.

The examples provided above are not meant to be exclusive. Many other variations of the present invention would be obvious to those skilled in the art, and are contemplated to be within the scope of the appended claims.

I claim:

1. A fixing end for cores used in reeling, comprising a substantially cylindrical frame having an outer surface, said frame being insertable into an open end of the core, bevelled holes formed in said frame and opening onto said outer surface thereof, a movable, elongate wedge piece situated in each of said holes, each of said wedge pieces having a holding surface at one end thereof proximate to said outer surface and engageable with an inner surface of the core, and means for moving each of said wedge pieces in a direction of its respective longitudinal axis in the respective one of said holes such that said holding surfaces of said wedge pieces are moved radially outward relative to said frame until said holding surfaces extend beyond said outer surface of said frame and engage and lock said fixing end to said inner surface of the core.

2. The fixing end of claim 1, wherein an angle between the longitudinal axis of each of said wedge pieces and said holding surface thereof is substantially the same as an angle between a longitudinal axis of said fixing end and an axis of said holes formed in said outer surface of said frame.

3. The fixing end of claim 1, wherein said wedge pieces have a round cross-sectional shape and said holes in said outer surface of said frame have a corresponding shape.

4. The fixing end of claim 1, wherein said holding surface of each of said wedge pieces is substantially planar.

5. The fixing end of claim 1, wherein said holding surface of each of said wedge pieces is substantially rounded.

6. The fixing end of claim 1, wherein said wedge pieces are moved in the longitudinal direction by actuation means, further comprising means for fastening said actuation means to said wedge pieces.

7. The fixing end of claim 1, wherein the axial motion of each of said wedge pieces is provided by axial movement of the core relative to said fixing end.

8. The fixing end of claim 6, further comprising an arrangement in which the axial motion of said wedge pieces relative to said frame moving by actuation of said actuation means is prevented but the radial motion is possible.

9. The fixing end of claim 6, wherein said fastening means comprise a T-shaped projection arranged at an end of each of said wedge pieces opposite to the end proximate to said outer surface and a movable frame part arranged in said frame and having T-shaped grooves for receiving said T-shaped projection of said wedge pieces.

10. The fixing end of claim 1, further comprising a stopper piece arranged on said frame, said stopper piece limiting movement of the core over said fixing end.

11. The fixing end of claim 1, wherein each of said wedge pieces comprises an end part connected to the end proximate to said outer surface of said frame, further comprising an annular member connected to said end parts of said wedge pieces, said annular member engaging with the core.

12. The fixing end of claim 11, further comprising a spring member coupled to each of said wedge pieces for returning said wedge pieces into said holes.

* * * * *